US010252840B2

(12) United States Patent
Mebberson

(10) Patent No.: US 10,252,840 B2
(45) Date of Patent: Apr. 9, 2019

(54) BOTTLE LID ASSEMBLY WITH RETRACTABLE SPOUT

(71) Applicant: PURATAP PTY LTD, Stepney, South Australia (AU)

(72) Inventor: Nick Mebberson, Stepney (AU)

(73) Assignee: PURATAP PTY LTD (AU)

( * ) Notice: Subject to any disclaimer, the term of this patent is extended or adjusted under 35 U.S.C. 154(b) by 104 days.

(21) Appl. No.: 15/512,374

(22) PCT Filed: Sep. 22, 2015

(86) PCT No.: PCT/AU2015/050567
§ 371 (c)(1),
(2) Date: Mar. 17, 2017

(87) PCT Pub. No.: WO2016/044890
PCT Pub. Date: Mar. 31, 2016

(65) Prior Publication Data

US 2017/0275061 A1 Sep. 28, 2017

(30) Foreign Application Priority Data

Sep. 23, 2014 (AU) ..... 2014903796

(51) Int. Cl.
*B65D 47/06* (2006.01)
*B65D 47/24* (2006.01)
(Continued)

(52) U.S. Cl.
CPC ..... *B65D 47/061* (2013.01); *B65D 1/02* (2013.01); *B65D 47/244* (2013.01); *B65D 47/265* (2013.01)

(58) Field of Classification Search
CPC .. B65D 47/061; B65D 47/244; B65D 47/265; B65D 47/24; B65D 47/241;
(Continued)

(56) References Cited

U.S. PATENT DOCUMENTS 4,183,443 A * 1/1980 DeParales ..... A47G 19/2272 220/714
4,691,589 A 9/1987 Arakawa
(Continued)

FOREIGN PATENT DOCUMENTS

CN 201268440 Y 7/2009
EP 1477420 11/2004
(Continued)

*Primary Examiner* — Paul R Durand
*Assistant Examiner* — Andrew P Bainbridge
(74) *Attorney, Agent, or Firm* — Sand, Sebolt & Wernow Co., LPA

(57) ABSTRACT

There is provided a lid assembly for a bottle, including a base attachable to said bottle over an mouth thereof, a main body rotatably connected to said base, a cover configured to extend over an open upper end of the main body, the cover including an opening extending therethrough, and a spout slidably held within said body and movable along a first axis between a retracted position in which the spout is located within the main body and an extended position in which the spout projects through said opening in the cover, wherein said opening in the cover is closed when the spout is in said retracted position.

13 Claims, 16 Drawing Sheets

(51) Int. Cl.
*B65D 1/02* (2006.01)
*B65D 47/26* (2006.01)

(58) Field of Classification Search
CPC .. B65D 47/242; B65D 47/246; B65D 47/248; B65D 47/26; B65D 1/02
USPC ..... 222/153.14, 519–521, 549, 559–560
See application file for complete search history.

(56) References Cited

U.S. PATENT DOCUMENTS 5,004,127 A * 4/1991 Morel ..... B05B 11/0027 222/505
5,244,113 A 9/1993 Stymiest
5,282,541 A * 2/1994 Chen ..... A47G 19/2266 215/12.1
5,713,493 A * 2/1998 Garibaldi ..... B65D 47/244 222/153.06
6,010,029 A * 1/2000 Wang ..... B65D 47/265 220/254.4
6,102,259 A 8/2000 Tsamourgelis et al.
6,332,551 B1 * 12/2001 Copeland ..... B65D 47/265 220/262
6,626,314 B1 * 9/2003 McHenry ..... B65D 47/265 220/254.2
7,093,735 B2 * 8/2006 Stephens ..... A47G 19/2266 215/250
7,819,280 B2 * 10/2010 Perra ..... B65D 47/265 220/821
8,393,487 B1 * 3/2013 Pillers ..... B65D 51/16 220/253
8,469,226 B2 * 6/2013 Davies ..... A47G 19/2266 220/707
8,550,269 B2 * 10/2013 Lane ..... B65D 47/066 215/229
10,023,366 B2 * 7/2018 Gilbert ..... B65D 47/245
2003/0183662 A1 * 10/2003 Ingram ..... B65D 47/263 222/548
2004/0116036 A1 6/2004 Nugent et al.
2006/0180585 A1 * 8/2006 Cunningham ..... A47G 19/2266 220/203.06
2010/0108724 A1 * 5/2010 Buchalter ..... B65D 47/242 222/521
2011/0049195 A1 * 3/2011 Russell ..... B65D 47/244 222/513
2013/0153085 A1 * 6/2013 Shefler ..... B65D 1/04 141/9
2017/0318993 A1 * 11/2017 Young ..... B65D 47/248

FOREIGN PATENT DOCUMENTS

EP 1477420 A1 11/2004
FR 1185853 8/1959
JP H0369465 3/1991
JP H0369465 A 3/1991

* cited by examiner

BOTTLE LID ASSEMBLY WITH RETRACTABLE SPOUT

TECHNICAL FIELD

The present invention relates to a bottle lid assembly with a retractable spout that can be used for drinking or pouring. The invention in one form can be used on a beverage container.

BACKGROUND OF INVENTION

Many different water bottles and the like are currently available in the market. A very simple form of water bottle includes a spout integrally formed with a bottle. The spout has an external thread arranged to engage with a threaded cap.

A number of lids for bottles have been proposed in the prior art that incorporate an integral spout or straw. One such lid assembly is disclosed in U.S. Pat. No. 5,244,113(STYMIEST), which describes a lid assembly for a container that has both a pour opening and a drinking straw opening. Each opening has a corresponding closure hingedly connected to the lid for sealing the opening. Each closure must be manipulated by the user to move them between the closed and open positions.

U.S. Pat. No. 8,550,269 (LANE), describes a drink bottle with a removable lid. The removable lid includes an inner portion arranged to be attached to the mouth of the bottle and an outer cover pivotably mounted to the inner portion. A pliable drinking spout extends from the inner portion and provides a fluid passage from the bottle through said spout. The cover is configured to conceal the drinking spout when it is closed and the cover may be locked into the closed position. The passage through the pliable drinking spout is closed off when the cover is closed due to the drinking spout being bent over and because of an engagement with a counter ridge formed on the cover. A push button release is activated to unlock the cover and to permit it to be pivoted to a position in which the drinking spout is exposed for access by the user.

Another lid is disclosed in U.S. Pat. No. 8,469,226 (DAVIES et al.), that teaches a cap or lid that includes a mouthpiece assembly configured to be moved between a dispensing position and a stowed position. The mouthpiece is biased to the dispensing position and is held in the stowed position by a catch. The mouthpiece however is to a degree exposed when in the stowed position unlike the apparatus disclosed in LANE.

There are a number of problems with the existing bottle lids including having the mouthpiece exposed to contaminants or being difficult to operate with multiple rotations required to open the lid. Furthermore, where flexible straws are used they have a tendency to perish over time or split where they are repeatedly bent. The present invention therefore seeks to provide an improved form of bottle lid assembly.

The discussion of the background to the invention herein is included to explain the context of the invention. This is not to be taken as an admission that any of the material referred to was published, known or part of the common general knowledge as at the priority date of this application.

SUMMARY OF INVENTION

It could be broadly understood that the present invention relates to a bottle lid assembly incorporating a spout that is covered by a lid when not in use so as to prevent contamination of the spout and which exposes the spout to the user through the lid upon activation of a mechanism by the user, for example a push button mechanism.

According to one form of the invention but not necessarily the broadest or only aspect, there is provided a lid assembly for a bottle, including a base attachable to said bottle over an mouth thereof, a main body rotatably connected to said base, a cover configured to extend over an open upper end of the main body, the cover including an opening extending therethrough, and a spout slidably held within said body and movable along a first axis between a retracted position in which the spout is located within the main body and an extended position in which the spout projects through said opening in the cover, wherein said opening in the cover is closed when the spout is in said retracted position.

Preferably the main body is configured to rotate relative to the bottle to thereby move the spout between the retracted and extended positions.

Preferably the spout is biased toward an extended position wherein the spout projects out through the opening in the cover. In one form a biasing member drives the spout from the retracted position to the extended position. The biasing member may be selected from a group containing, but not limited to a helical spring, gas strut, compression spring, torsion spring, constant tension spring or elastomer block. Other means for driving the spout from the retracted position to the extended position are also possible, including fully manual rotation, wherein the spout can be moved from the retracted position into the extended position by manual rotation of the main body in one direction and then back into the retracted position by manual rotation of the main body in an opposite direction.

The spout is preferably held in the retracted position by a releasable latch or mechanism that can be operated by a user to move the spout from the retracted position to the extended position. The releasable latch includes some form of release mechanism that can be operated by the user, such as but not limited to, a button, switch or catch.

The releasable latch may preferably be lockable by a locking member to inhibit inadvertent activation of the release mechanism of said latch. The locking member may be in one form a slide member that inhibits operation of the latch. The releasable latch is preferably arranged so that it prevents rotation of the main body when in a non-activated condition and allows rotation of the main body when in an activated condition. In accordance with a preferred embodiment, the releasable latch is a push button which is activated by inward pressure by the user, generally towards a vertical centre line extending through the lid assembly.

The locking member may include a forwardly extending portion that can engage with a slot or indent in the side of the latch to inhibit it from being pushed inward. The forwardly extending portion can be disengaged from said slot to permit activation of the latch.

The main body is preferably arranged to engage with the spout so that under the influence of the biasing member the main body rotates in a first direction upon release or activation of the latch. When the main body rotates in the first direction, the spout is able to move along the first axis under the bias of the biasing means. The first axis extends generally longitudinally of the length of the bottle. Rotation of the main body in a second direction, opposite to the first direction, drives the spout along the first axis against the bias of the biasing member. In a preferred form rotation in the second direction is affected or caused by the manual rotation of the main body by the user. Preferably, when the spout is driven to the retracted position, the releasable latch is returned to the non-activated condition to thereby prevent rotation of the main body under the influence of the biasing member.

Preferably at least one inwardly projecting flange or groove is located on or in an inner wall of the main body that engages with protrusions on a side of a spout member. In one form the inwardly projecting flange or groove may take the form of a thread member. Although described as being a thread member it should be appreciated that other forms of projections or grooves could be used without departing from the scope of the invention, for instance an oblique or rising shoulder or shoulders could be used to provide the slidable engagement between the main body and the spout member.

Each flange of the thread member is parallel and angled upwardly and to one side along the longitudinal axis of the main body.

In one form the spout and main body are engaged together by a flange configuration that could be described as at least one thread. The thread is preferably a three start thread and the spout preferably includes three engagement fingers, one for engagement with each start of the thread. The fingers are preferably arranged to engage an underside of the thread start and so that the bias of the biasing member tends to drive the fingers upwardly along the underside of the thread.

Preferably, a flap is provided to conceal the opening in the cover when the spout is in the lowermost position. The flap is preferably arranged for movement in a plane substantially perpendicular to said first axis so that the flap can be moved between a first position in which it blocks the opening in the cover and a second position in which it is clear of the opening in the cover, to thereby allow movement of the spout therethrough. In one form the flap rotates about a shaft that has an axis that is parallel to said first axis. The flap is preferably substantially located below the lid and over the top of the spout when the spout is in the retracted position.

The flap is preferably arranged to be driven between the first and second position by rotation of the main body. A spur gear member and pinion arrangement is preferably established between the flap and main body to achieve drive of the flap. The spur gear member and pinion arrangement is configured to ensure that the flap is opened in a timely manner with respect to movement of the spout along the first axis. This prevents the spout from striking the underside of the flap as it pivots out of the way. In a preferred form the spur gear member is located on, or adjacent an inner wall the main body and the pinion is located on a rear or proximal end of the flap adjacent said shaft. The reader will appreciate that the internal spur gear member and pinion only engage for a period of time during rotation of the main body to move the flap.

Rotation of the main body and hence the speed of movement of the spout along the first axis is preferably arranged to be dampened by a dampening assembly. The dampening assembly may include at least one gear and at least one viscous damper. Other dampening arrangements could also be used.

BRIEF DESCRIPTION OF DRAWINGS

The accompanying drawings, which are incorporated in and constitute a part of this specification, illustrate an implementation of the invention and, together with the description and claims, serve to explain the advantages and principles of the invention. In the drawings:

DETAILED DESCRIPTION

Figure 1:
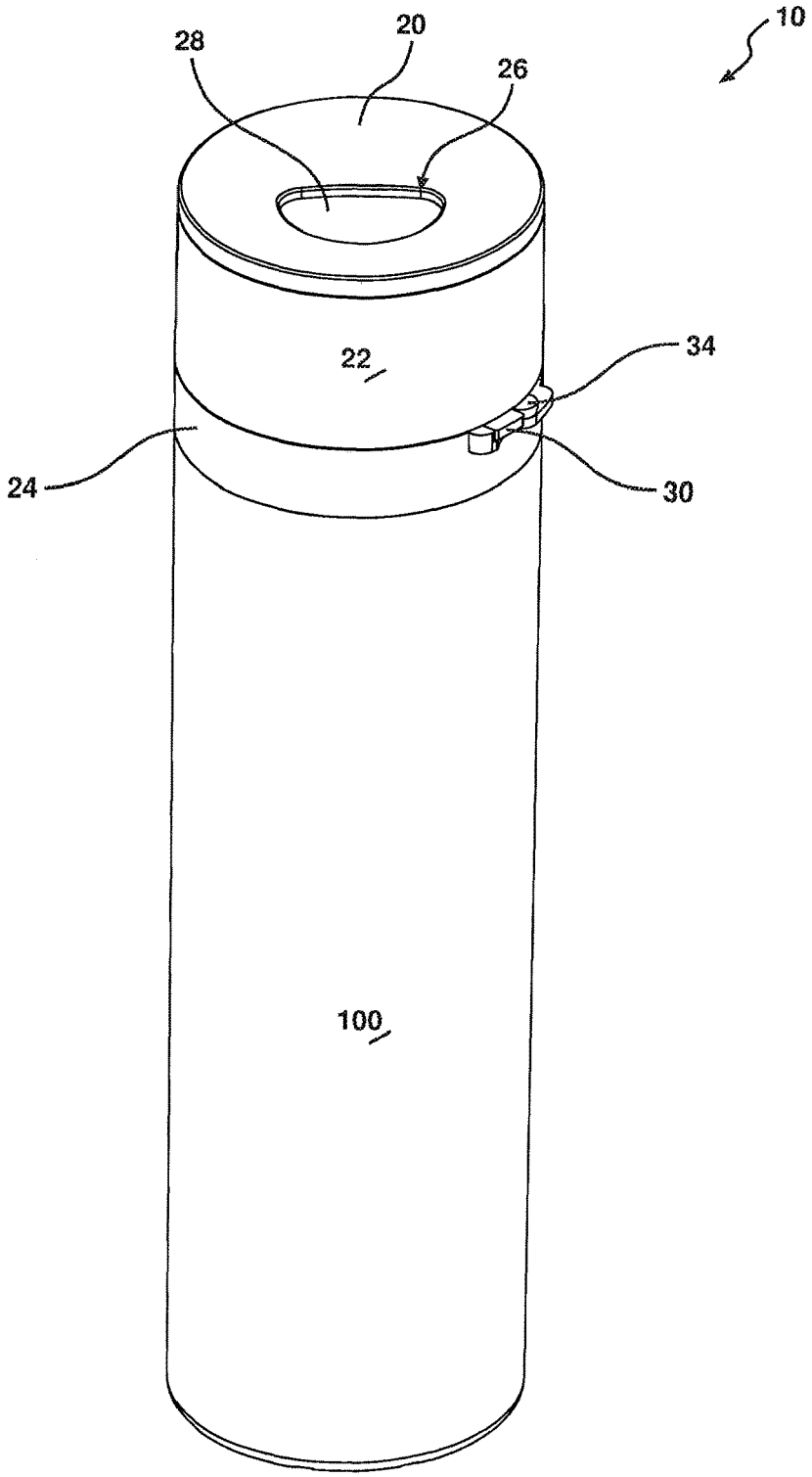
FIG. 1 is an isometric view of a bottle fitted with a lid assembly in accordance with an embodiment of the invention, illustrating the lid assembly is shown in the closed position.

Similar reference characters indicate corresponding parts throughout the drawings. Dimensions of certain parts shown in the drawings may have been modified and/or exaggerated for the purposes of clarity or illustration.

Figure 2A:
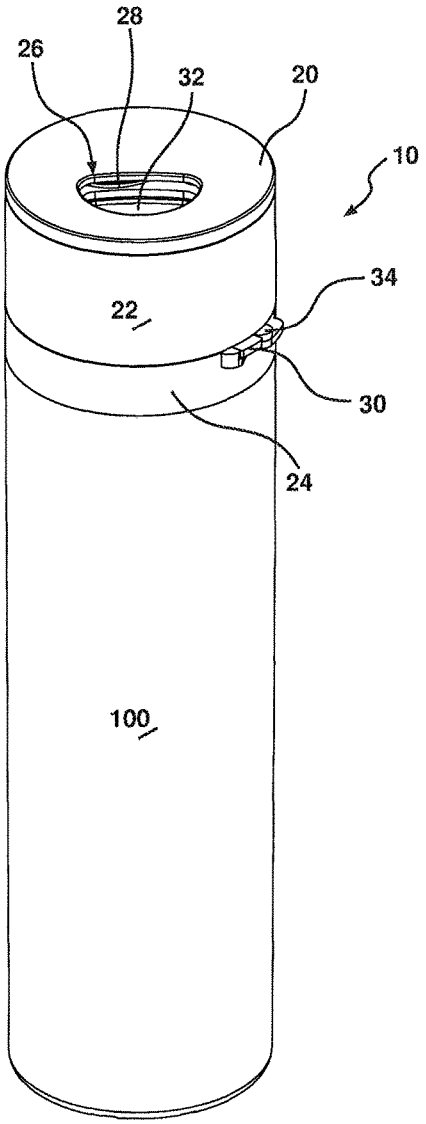
FIG. 2*a* is a view similar to FIG. 1 but with the lid assembly shown in a partially open position.
Figure 2B:
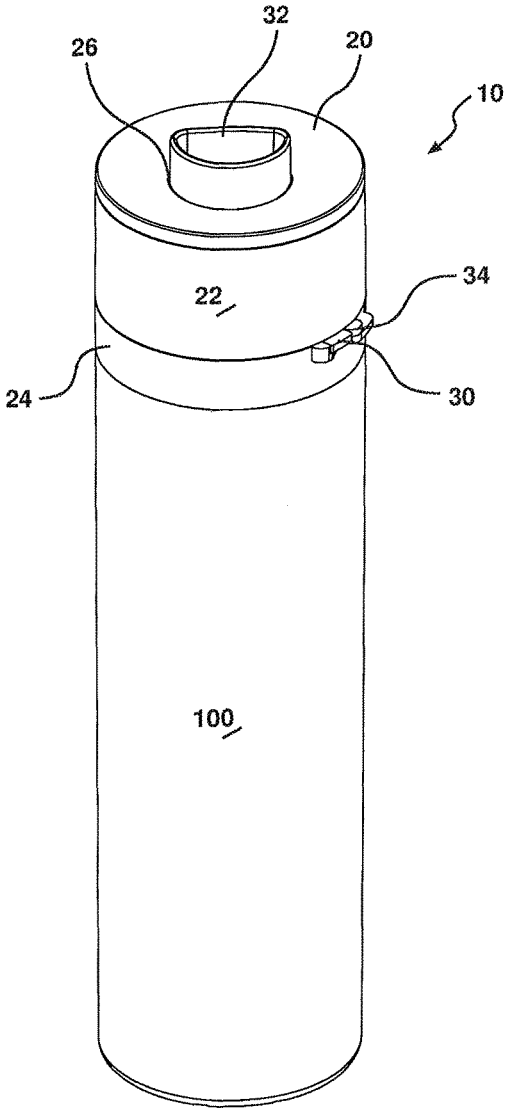
FIG. 2*b* is a view similar to FIG. 1 but with the lid assembly shown in a fully open position.

Referring to the drawings for a more detailed description, there is illustrated an bottle lid assembly 10, demonstrating by way of examples, arrangements in which the principles of the present invention may be employed. FIGS. 1 to 2*b* illustrate a bottle lid assembly 10 in accordance with an embodiment of the invention attached to a bottle 100. The bottle lid assembly 10 includes a cover 20, a main body 22 and a spout 32. The cover 20 includes an opening 26 that can be closed as illustrated in FIG. 1. The spout 32 is arranged for movement along a first axis between a retracted position in which it is located within the main body 22 and below the cover 20, and an extended position in which the spout 32 extends through the opening 26 in the cover 20, as illustrated in FIG. 2*b*. The first axis extends generally parallel to the longitudinal axis of the lid assembly 10 and a bottle 100. The longitudinal axis of the lid assembly 10 with reference to FIG. 1 is a vertical axis.

The lid assembly 10 can be attached to any shape of size of bottle 100, although in the present embodiments the bottle is generally cylindrical. The reader should however appreciate that the shape of the bottle and lid assembly may take other shapes than generally cylindrical.

Lid assembly 10 further includes a base 24 arranged for connection to the bottle 100. Typically, the base 24 is arranged for threaded connection to the bottle 100, so that it can be detached for refilling the bottle 100.

The opening 26 in the cover 20 is closed from below by a flap 28. The releasable latch 30 in the present embodiment comprising a push button type mechanism provides a means for triggering the spout 32 to move from the retracted position to the extended position and to thereby move the lid assembly 10 between an open configuration, as illustrated in FIG. 2*b*, and a closed configuration, as illustrated in FIG. 1. In the open configuration of the lid assembly 10, the flap 28 clears the opening 26, as illustrated in FIG. 2*a*, to enable the spout 32 to move upwardly along the first axis through the opening 26 from the retracted position to the extended position. In the retracted position of the spout 32 as shown in FIG. 2*b*, the user can access fluid contained in the bottle 100 via the spout 32.

As will be explained in detail below, when the user has finished drinking or pouring fluid from the spout 32, they can manually rotate the main body 22. This manual rotation causes the spout 32 to move downwardly through the opening 26 and the flap 28 closes off the opening 26. Spout 32 is thereby located fully inside the lid assembly 10. Lid assembly 10 can then be locked in the closed configuration by movement of a locking member 34. In accordance with the illustrated embodiment, locking member 34 is configured to prevent inwardly directed movement of the latch 30 and thus inhibit movement of the lid assembly 10 to the open position. It will of course be appreciated that other forms of locking members are envisaged.

In the present embodiment the locking member 34 is configured to slidably engage the releasable latch 30 to prevent activation thereof, and is slidably held within locking member groove 50.

Figure 3A:
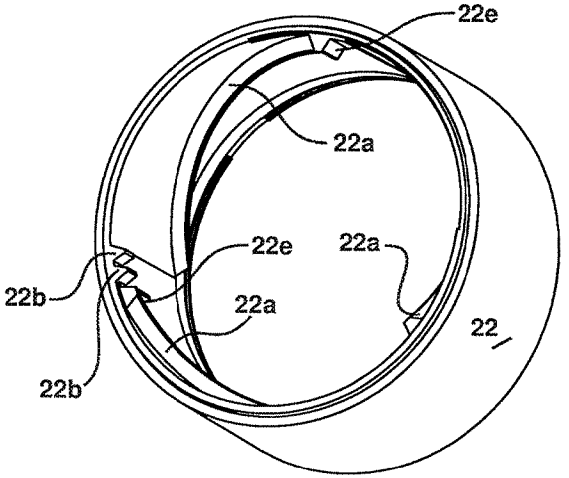
FIGS. 3*a*, 3*b* and 3*c* are respective first top, second top and bottom isometric views of the main body of the lid assembly shown in FIG. 1.
Figure 3B:
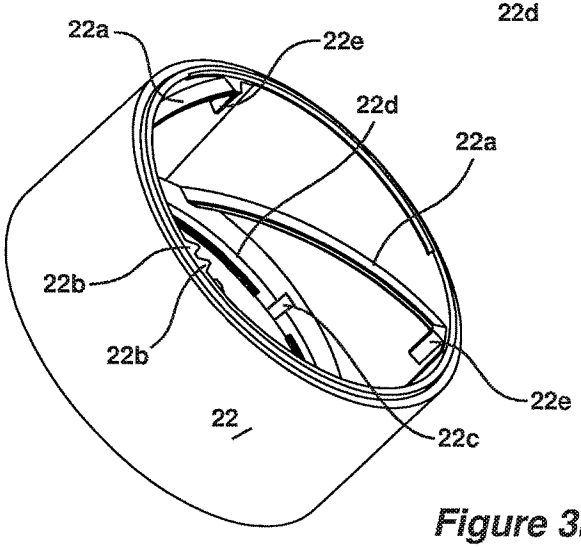
Figure 3C:
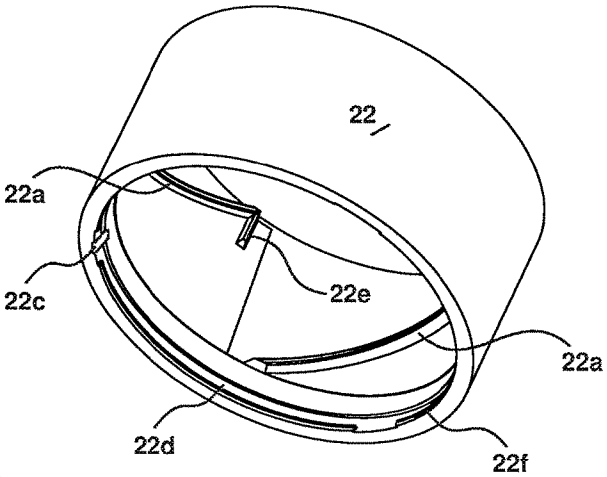

As shown in FIGS. 3*a*, 3*b* and 3*c*, main body 22 is formed as a cylindrical tubular member with flanges in the form of a flight or thread 22*a* located on its inner wall. The thread 22*a* is shown as a three start thread, although other flange, groove or shoulder configurations may be adopted without departing from the scope of the invention. Main body 22 is formed with gear teeth 22*b* positioned at an upper end and arranged, in use, to mesh with teeth 28*a* formed on the flap 28 (see FIGS. 14*a* and 14*b*). Formed in the lower internal wall of the main body 22 is an orientation slot 22*c*. The lower internal wall of the main body 22 also includes a circumferential groove 22*d*. The function of the orientation slot 22*c* and the groove 22*d* will be explained later. Each of the portions of the thread 22*a* includes a stop 22*e*.

Figure 4A:
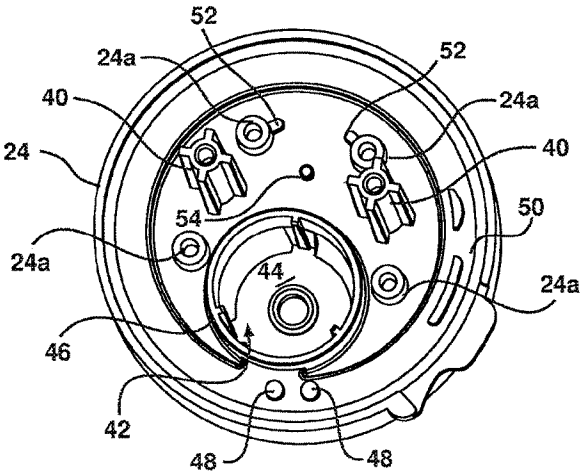
FIGS. 4*a* and 4*b* are respective top and side views of the base of the lid assembly shown in FIG. 1.
Figure 4B:
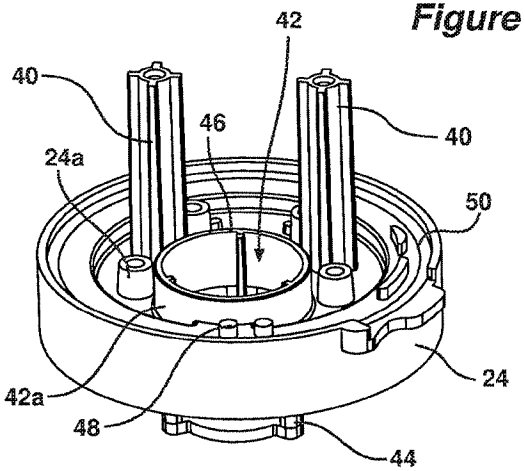

FIGS. 4*a* and 4*b* illustrate the base 24 in more detail. As depicted, in accordance with this embodiment, the base 24 is moulded as a single piece, although this is not essential and the base may be constructed from a number of integers. The base 24 includes connector apertures 24*a*, a pair of spring posts 40, opening 42, seal button seat 44, annular seal seat 46, push button posts 48, locking member groove 50, ridges 52 and locating pin 54.

Figure 5:
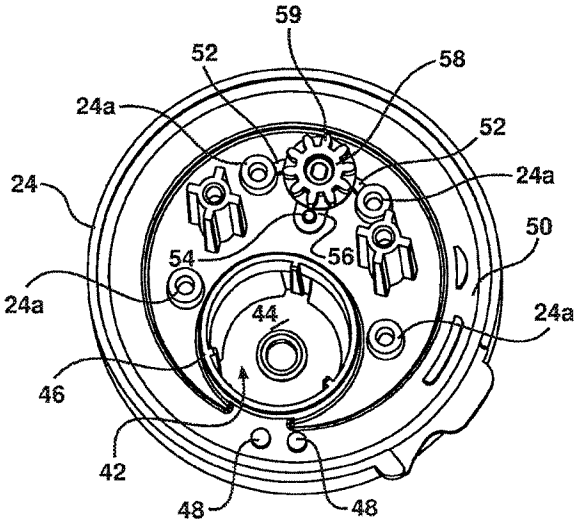
FIG. 5 is a view similar to FIG. 4A but with additional components located on the base.
Figure 10A:
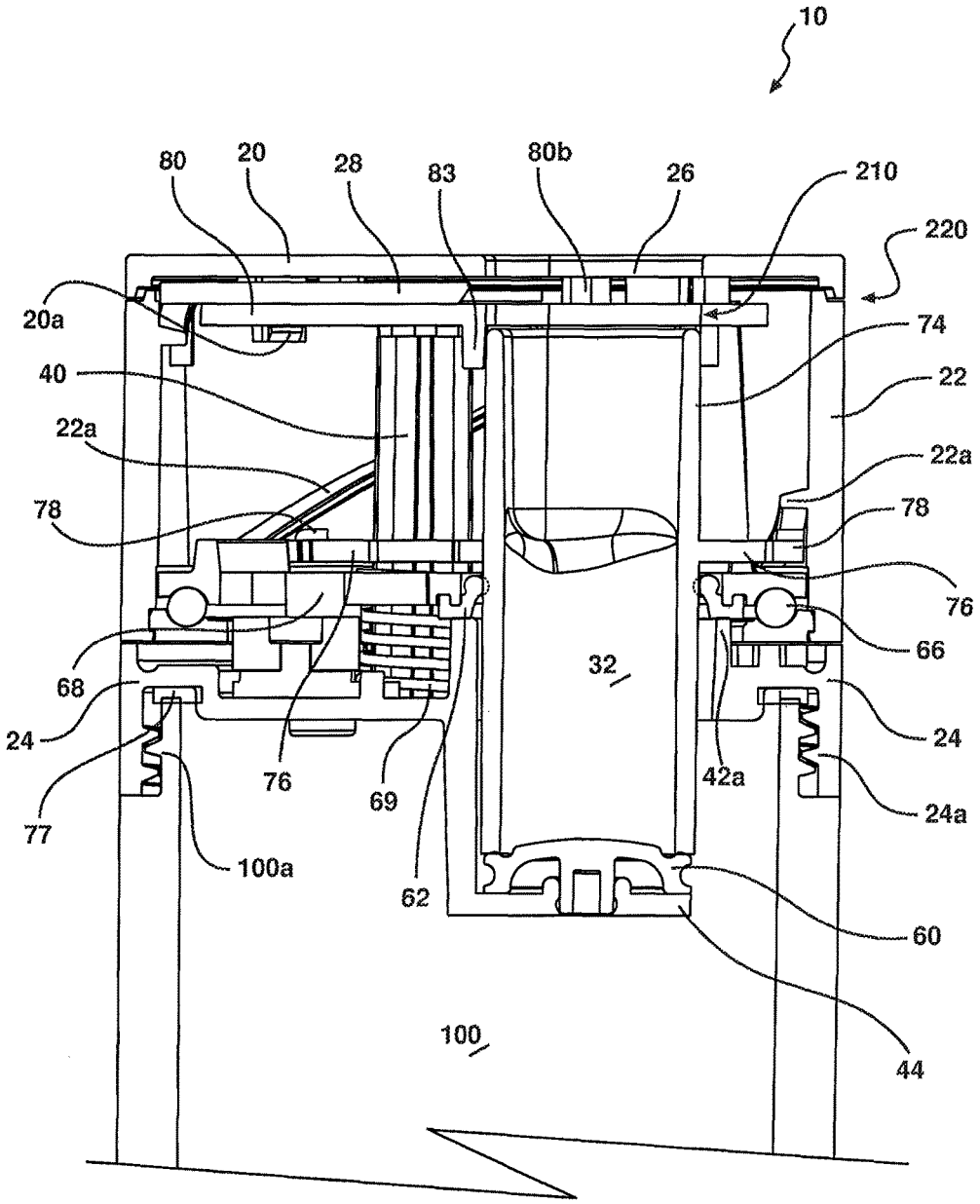
FIG. 10*a* is a first vertical cross-sectional view of the bottle and lid assembly as shown in FIG. 1.

FIG. 5 shows a damper 56 mounted on the locating pin 54 between the ridges 52. Ridges 52 located the damper 56 so that it cannot swing on the locating pin 54. Locating pin 54 is heat staked down to fix the position of the damper 56 and to prevent it lifting off the locating pin 54, although other ways of fixing are also possible. A damper gear 58 is mounted on the damper 56, a seal button 60 is mounted in the seal button seat 44, and an annular seal 62 is shown mounted on annular seal seat 46, as shown in FIG. 10*a*. Damper 56 may adopt different forms but in this instance is a viscous rotary damper. The annular seal 62 in the present embodiment is a wiper seal type configuration that maintains sealing contact with the spout 32. As illustrated in FIG. 10*a* the seal 62 is deformed or compressed by the spout 32. The undeformed configuration of the seal 62 is illustrated in the figures by the curved broken line. The reader should appreciate that the seal 62 is biased against the surface of the spout to inhibit passage of fluid therebetween. The wiper seal configuration ensures that there is low friction as the spout extends. An advantage with this type of seal is that it works with a lower tolerance housing. The groove inhibits it pulling out as the spout 32 extends and the frictional force tries to drag the seal out of position. The reader should however appreciate that other configurations of seals could be used without departing from the scope of the invention.

Figure 6A:
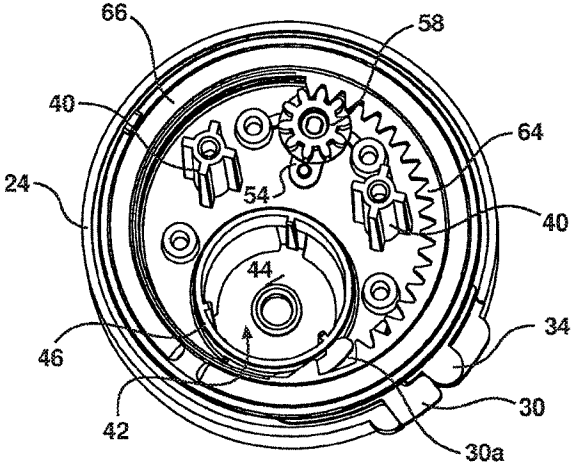
FIG. 6*a* is a view similar to FIG. 5 but with further additional components located on the base.

FIG. 6*a* is a view similar to FIG. 5 but shows the additional components of the latch 30 mounted on the push button posts 48, locking member 34 mounted in locking member groove 50, an internal spur gear 64 that engages with cooperating damper gear 58 and a ring bearing 66 mounted thereon, the ring bearing 66 is non-continuous which allows it to be positioned accurately on the seat or race 202 at all times during operation of the lid assembly.

Figure 6B:
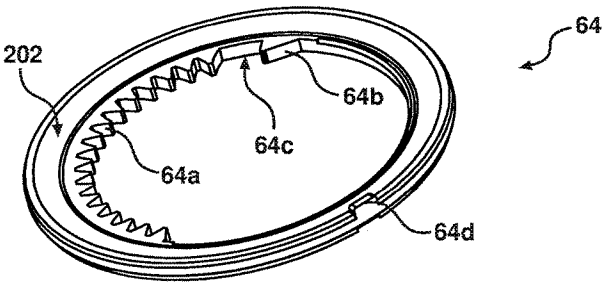
FIG. 6*b* is an isometric view of the internal spur gear shown in FIG. 6.

FIG. 6*b* illustrates the internal spur gear 64. As shown, spur gear 64 includes teeth 64*a*, teeth start 64*b*, locking gap 64*c* protrusion 64*d* and bearing seat 202. Protrusion 64*d* is formed in the external periphery of the spur gear 64 and is configured to receive the orientation slot 22*c* of the main body 22 when the internal spur gear 64 and main body 22 are connected together. The connection between the protrusion 64*d* and slot 22*c* ensures that the main body 22 and internal spur gear 64 are properly orientated with respect to each other.

Teeth 64*a* of the internal spur gear 64 are arranged to engage with the teeth 59 of the damper gear 58. Locking slot 64*d* is configured so that a detent 30*a* of the latch 30 can be received therein to lock the spur gear 64 against the bias of the biasing member that would otherwise cause rotation of the main body. This locking action of the latch 30 will be described in more detail later.

Figure 7:
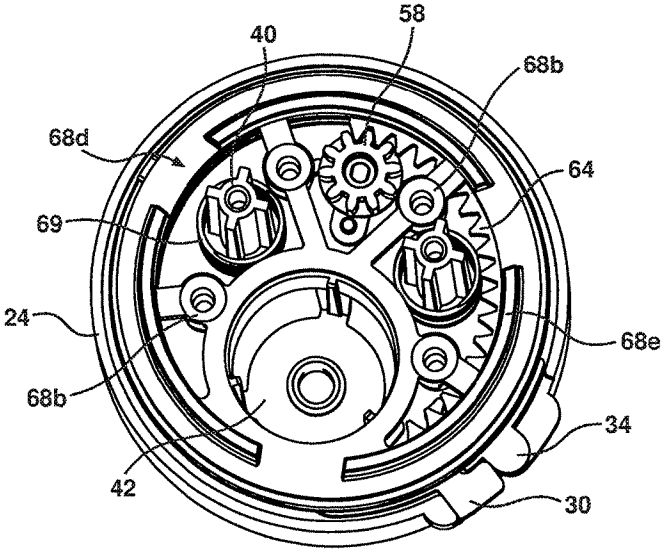
FIG. 7 is a view similar to FIG. 6*a* but with further additional components located on the base.

FIG. 7 further shows a positioning disc 68, which is arranged for connection to the base 24. Any suitable connectors can be used to secure the positioning disc 68 to the base 24. However, the positioning disc 68 must be secured so that the internal spur gear 64 can rotate with the main body 22 and relative to the positioning disc 68, which is held stationary relative to the base 24 whilst preventing unwanted vertical movement of the internal spur gear 64. The positioning disc 68 has a diameter that assists in maintaining the main body 22 in a centralised position by having a close fit. Springs 69 are shown mounted on the spring posts 40 and provide the biasing member for this embodiment. The springs 69 are shown in a compressed configuration in FIG. 7.

Figure 8A:
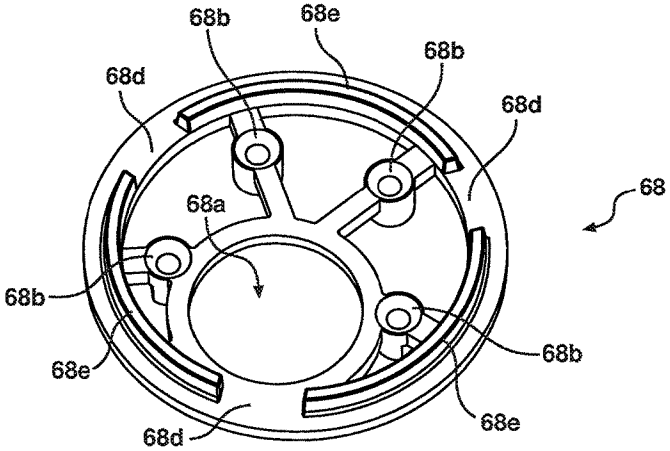
FIGS. 8*a* and 8*b* are respective top and side isometric views of the positioning disc shown in FIG. 7.
Figure 8B:
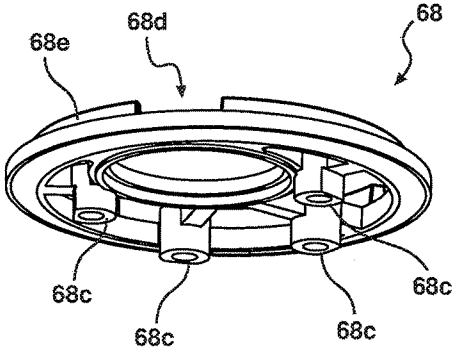
Figure 14A:
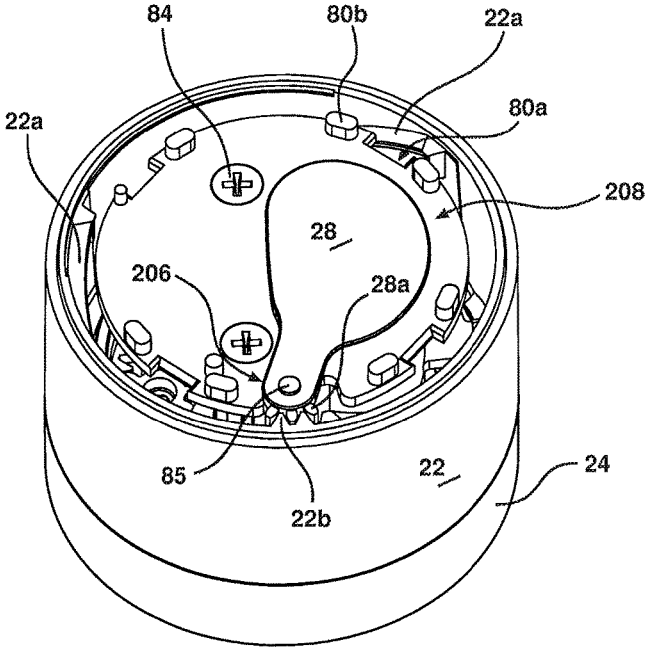
FIGS. 14*a* and 14*b* showing the lid assembly of FIG. 1 with the cover removed and the flap respectively in the first and second positions.

FIGS. 8*a* and 8*b* illustrate the configuration of the positioning disc 68 in more detail. Positioning disc 68 includes a main opening 68*a*, four connector apertures 68*b*, four feet 68*c* and three cut-outs 68*d* intermediate of upstands 68*e*. The connector apertures 68*b* are provided to enable connectors such as a screw (one of which is shown in FIG. 14*a*) to be used to connect the positioning disc 68 to the base 24. Accordingly connector apertures 68*b* are positioned to coaxially align connect apertures 24*a* in the base 24 and be fixed together by the screws. Feet 68*c* extend from the underside of the positioning disc 68 and are provided to maintain the required spacing between the underside of the positioning disc 68 and the base 24 to enable rotational movement of the internal spur gear 64. The feet 68*c* are dimensioned to prevent downward load exerted onto the positioning disc 68 from being transferred to the spur gear 64 whilst still restricting vertical movement of the positioning disc 68.

Figure 9B:
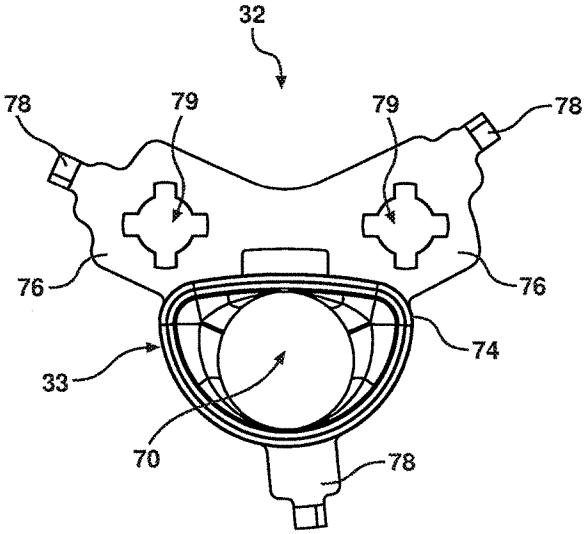
FIGS. 9*a*, 9*b* and 9*c* are respective isometric, top and bottom view of the spout of the lid assembly shown in FIG. 1.
Figure 9A:
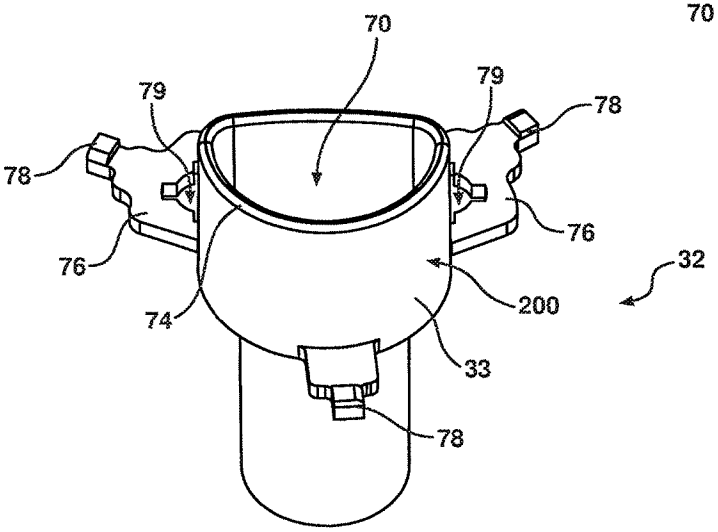
Figure 9C:
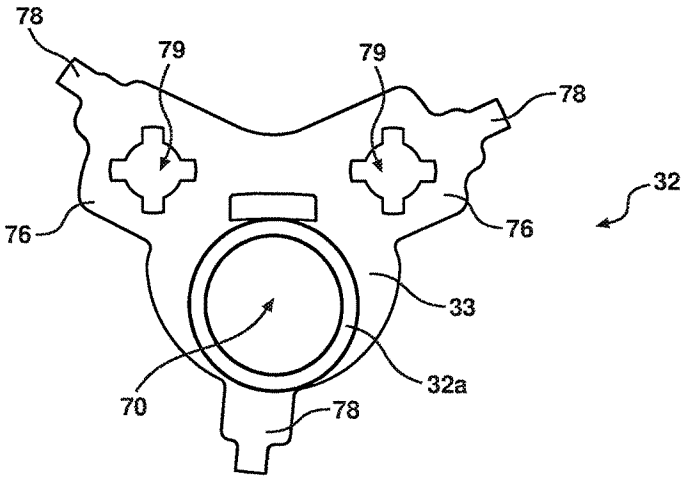

FIGS. 9*a*, 9*b* and 9*c* illustrate the spout 32. As shown, the spout 32 includes a body portion 33 incorporating a fluid pathway 70 that is bounded at an upper part 200 by a mouthpiece 74. The spout 32 also includes a pair of arms 76 and three fingers 78. The fingers 78 are located at about 120° to one another with respect to a central longitudinal axis of the spout 32. Each of the arms 76 includes an aperture 79. Each aperture 79 is sized so that it can be located over one of the spring posts 40 and so that the lower face of each arm 76 can be positioned during assembly of the lid assembly 10 against an upper face of the positioning disc 68 when the spout 32 is in the retracted position (i.e. with springs 69 compressed). The position of the spout 32 in such an arrangement is best shown in FIG. 10*a*. The fingers 78 are located within respective cut-outs 68*d* of the positioning disc 68.

The spring posts 40 have a lateral cross-sectional profile of generally a cross shape having equal length arms. The apertures 79 through the arms 76 of the spout member 32 have a shape that mirrors that of the spring posts 40 but of slightly larger dimensions. This means that the spout member 32 can slide up and down the spring posts 40 with minimal friction. The shape of the spring posts 40 and cooperatingly shaped apertures 79 inhibit the spring positioned over a spring post 40 from being caught in the gap between the edge of one of the aperture and the respective spring post.

Figure 18:
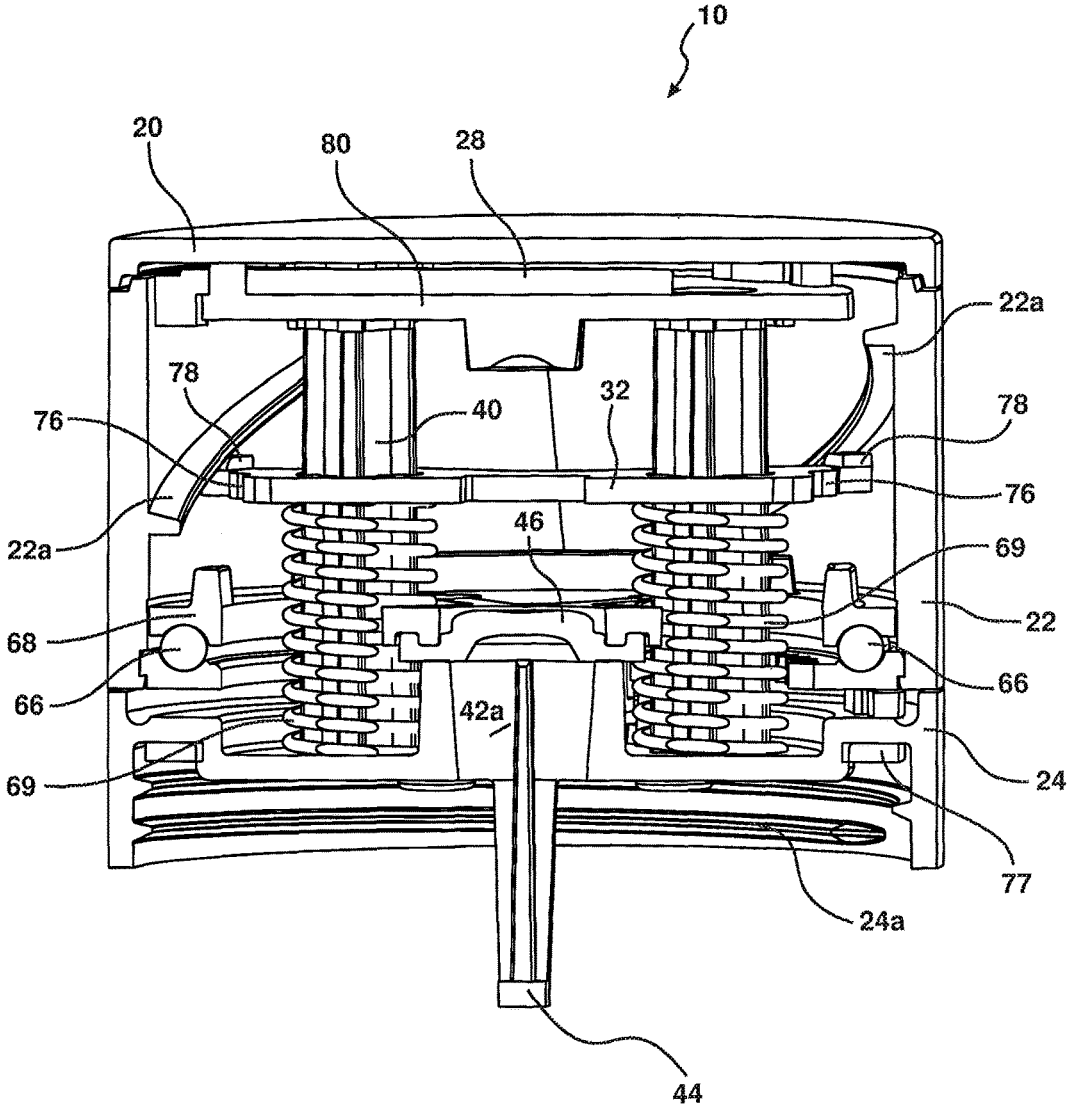
FIG. 18 is a perspective cross-section view of the bottle and lid assembly of FIG. 10*a*, illustrating the engagement of the fingers with the underside of the thread of the main body.

FIG. 10*a* illustrates the spout 32 in the retracted position within the lid assembly 10. The lower face of each arm 76 is shown in contact with the upper face of the positioning disc 68. Springs 69 are compressed between the base 24 and the underside of the arms 76 of the spout 32. As illustrated in FIG. 18, the fingers 78 of the spout 32 bear against the underside of the respective starts of the thread 22*a* and are held against the underside of the thread 22*a* by the influence of the springs 69, which helps to remove any slop or play between the spout 32 and main body 22. Spout 32 is held in the retracted position against the upward bias of the springs 69 by the detent 30*a* of the push button 30 which is engaged in the locking gap 64*c* of the internal spur gear 64. When the detent 30 is thus engaged, the internal spur gear 64 and connected main body 22 are prevented from rotating and thus the fingers 78 of the spout 32 are locked up against the underside of the starts of the thread 22*a*.

As illustrated in FIG. 10*a* the base 24 includes thread 24*b* (not to be confused with thread 22*a* in the main body). The thread 24*b* is configured to engage with a correspondingly shaped thread 100*a* in the bottle 100. A seal 77 is positioned between the base 24 and bottle 100 to inhibit leakage. There is also a small gap 220 between the underside of the cover 20 and the upper surface of the main body 22 to inhibit friction therebetween.

FIGS. 10*a* to 11*c* illustrate the relative positioning of the internal spur gear 64, ring bearing 66 and the positioning disc 68. Ring bearing 66 sits on a seat or race 202 formed in the upper face of the internal spur gear 64. As shown, ring bearing 66 is formed as a split ring of circular cross-section. Ring bearing 66 is configured to act as a bearing allowing the internal spur gear 64 to rotate (together with the main body 22) relative to the stationary positioning disc 68. The ring bearing 66 is preferably made from a low friction, low wear material such as HDPE or nylon or Teflon® or acetyl and is preferably made of a different material to that of the race or seat 202 in which or on which it sits. Other bearing arrangements are envisaged such as a race and ball arrangement. Damper gear 58 engages with the teeth 64*a* of the spur gear 64 and rotation of the spur gear 64 is dampened by dampener 56. As shown in the Figures, the curvature radius of the race 202 (i.e. ring bearing seat) is larger than the curvature radius of a cross-section of the ring bearing 66 so that sliding type line contact is preferably achieved, as opposed to face contact. It is envisaged that the main sliding face components will be constructed from acetyl, and the base, main body and lid will be constructed from polyester, however the invention is not limited to these materials.

Figure 10B:
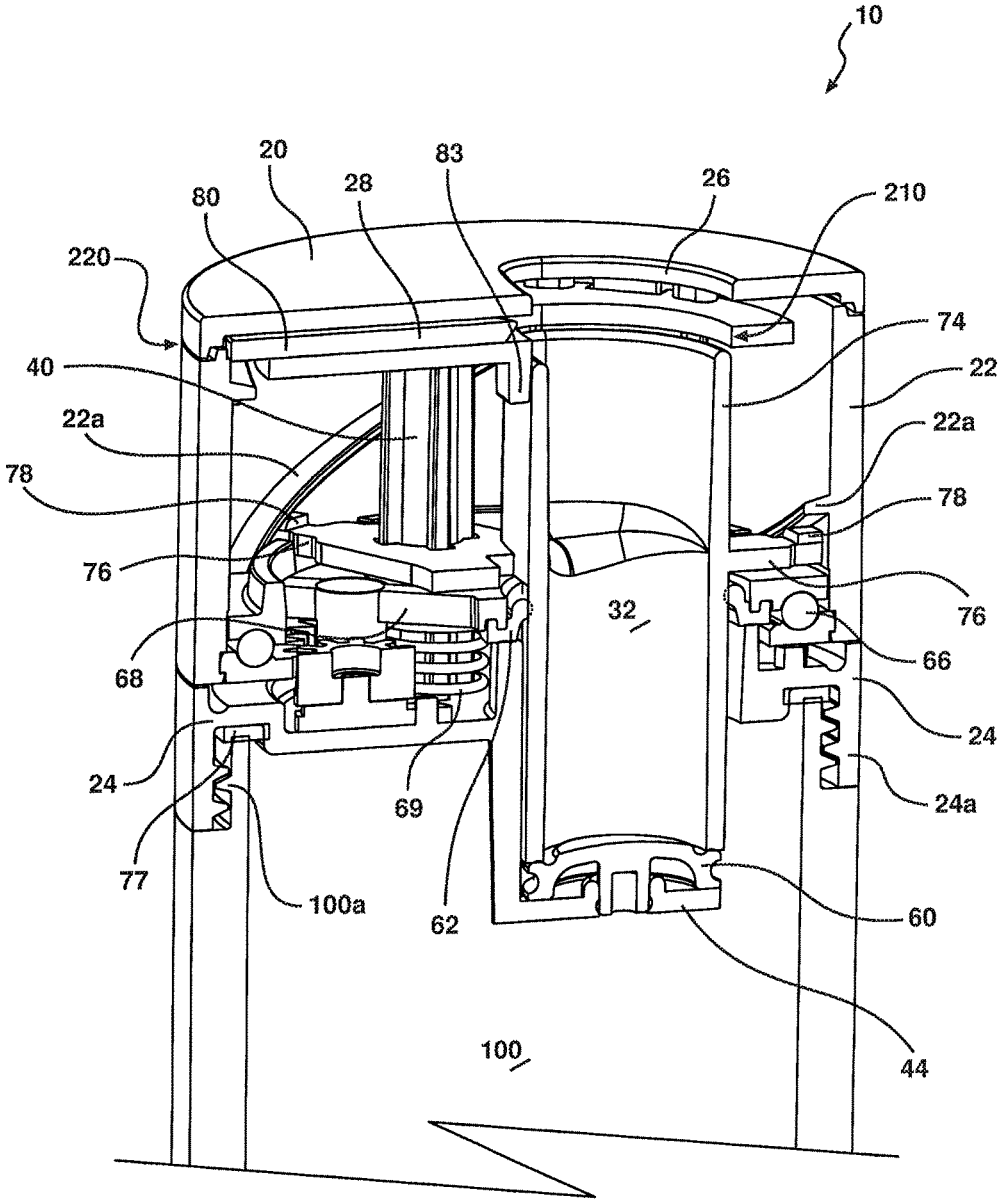
FIG. 10*b* is a perspective cross-sectional view of the bottle and lid assembly of FIG. 10*a*.

FIG. 10*b* also clearly depicts how the peripheral edge of the internal spur gear 64 is located within the circumferential groove 22*d* of the main body 22. This is achieved by a snap type fit once the slot 22*c* of the main body 22 is vertically aligned with the protrusion 64*d* of the internal spur gear 64. The lowermost edge of the main body 22 is chamfered to enable the main body 22 to press fit over the internal spur gear 64 to enable the peripheral edge of the spur gear 64 to locate within groove 22*d*. The reader should appreciate that the main body 22 and internal spur gear 64 may otherwise be joined such as by gluing or welding.

It will be noted that main body 22 is effectively held between the cover 20 and the base 24. This is achieved because the cover 20 is connected to the mounting plate 80, which is connected to the base 24 via the connections to the spring posts 40. A small gap 220 is provided between the upper edge of the main body 22 and the underside of the cover 20. This gap 220 enables the main body 22 to rotate relative to the lid 22. Alternatively the underside of the cover 20 can slide across the upper edge of the main body 22 with minimal friction. However this is accomplished the reader will appreciate that the main body 22 is able to rotate relative to the cover 20.

Figure 11A:
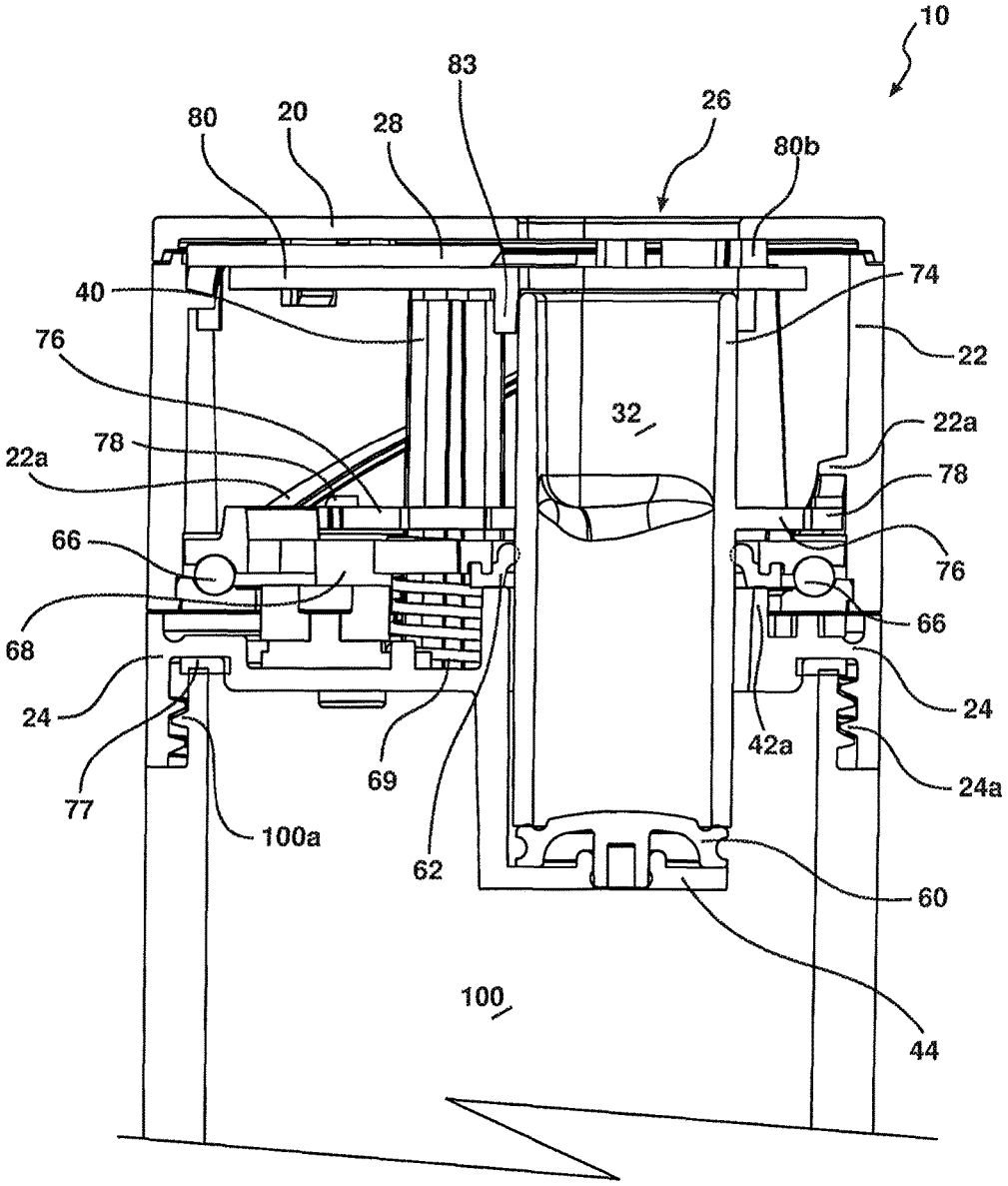
FIG. 11*a* is a cross-sectional view of the bottle and lid assembly as shown in FIG. 10*a*.
Figure 11B:
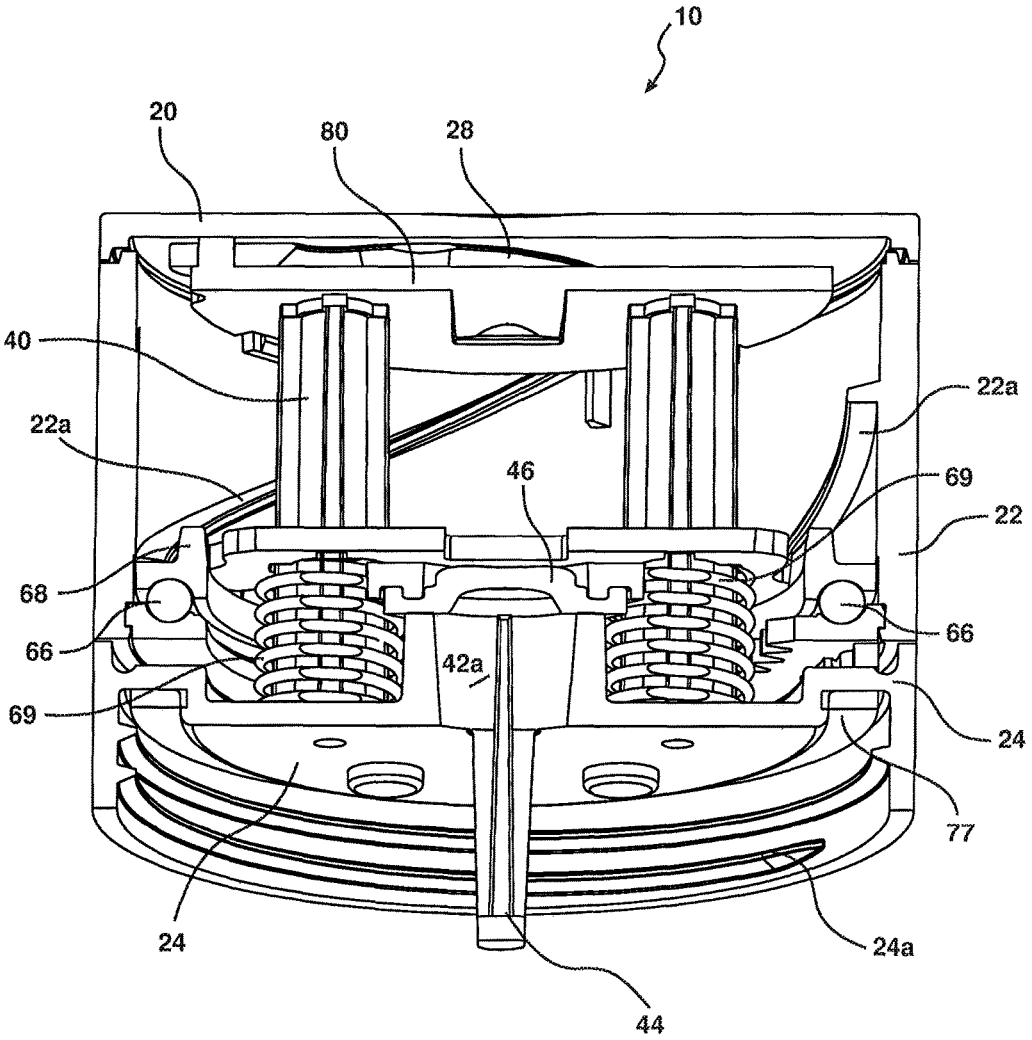
FIG. 11*b* is a perspective cross-section view of the bottle and lid assembly of FIG. 10*a*, illustrating the spout in a retracted position.
Figure 11C:
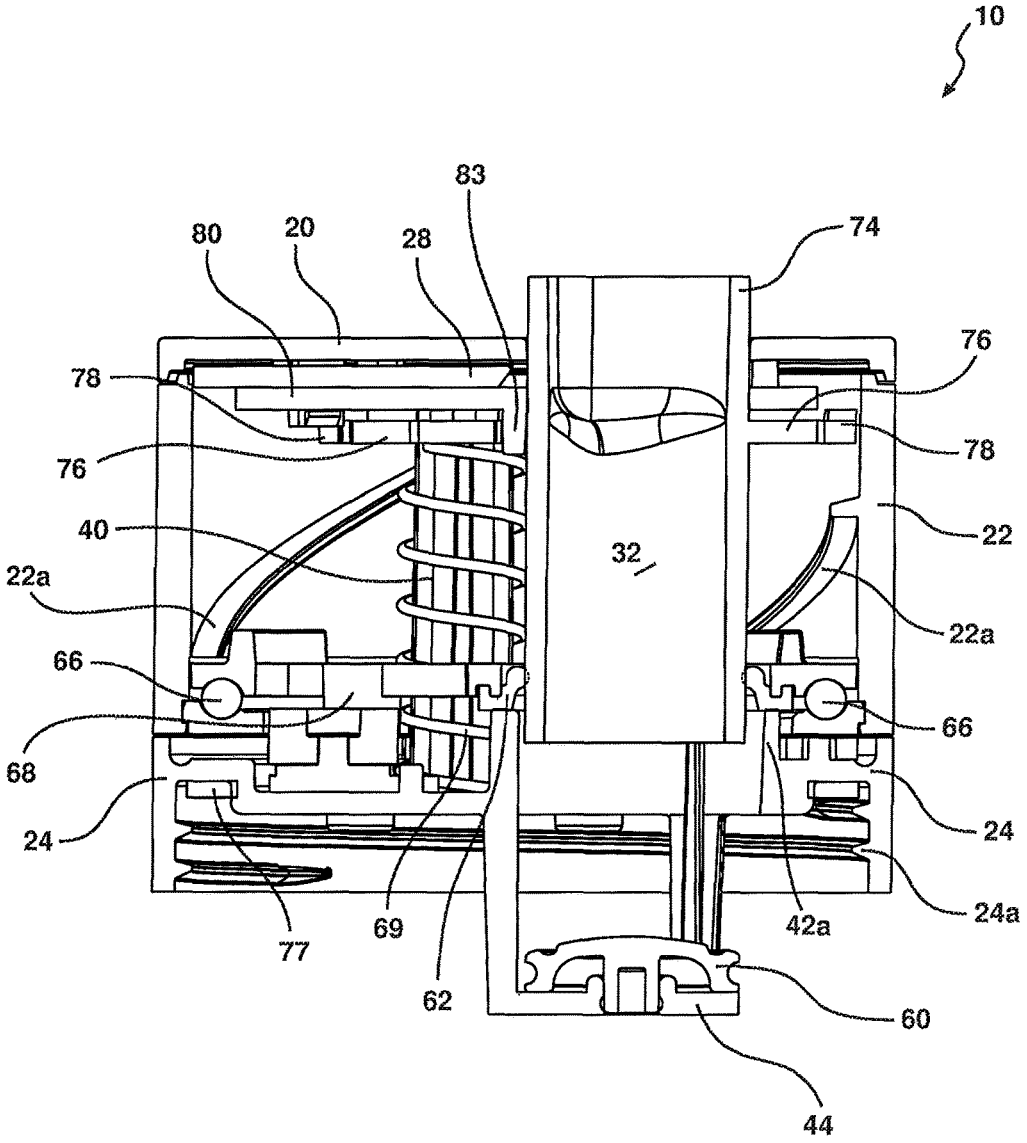
FIG. 11*c* is a perspective cross-section view of the bottle and lid assembly of FIG. 10*a*, illustrating the spout in an extended position.
Figure 12A:
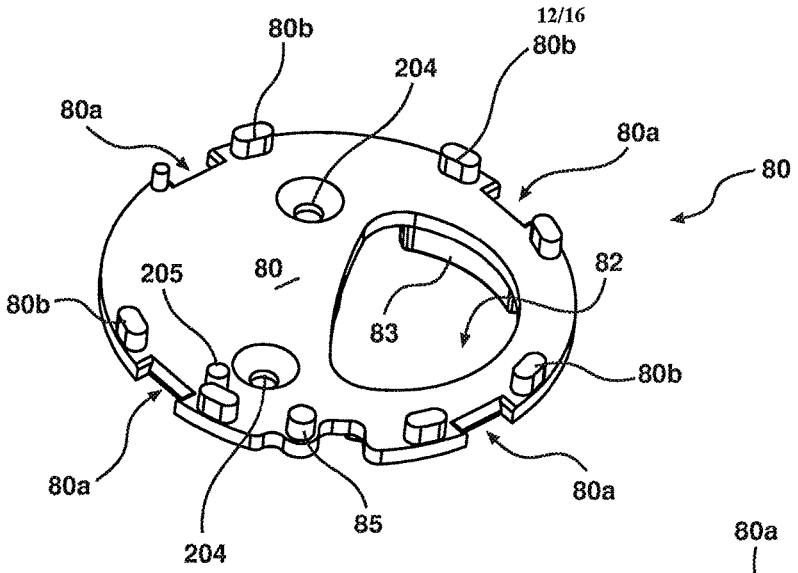
FIGS. 12*a* and 12*b* are respective top and bottom isometric views of the mounting plate of the lid assembly of FIG. 1.
Figure 12B:
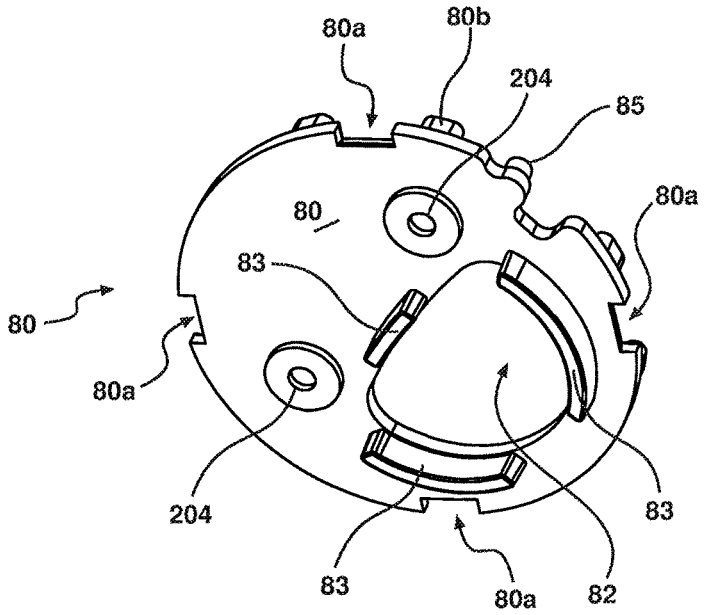

Spring posts 40 establish a mounting surface for a circular shaped mounting plate 80 (FIGS. 12*a* and 12*b*). Mounting plate 80 includes an opening 82 that is arranged in use of the lid assembly 10 to vertically align with the opening 26 formed in the cover 20. The opening 82 is of similar dimensions in a horizontal plane to the opening 26, although opening 26 may be larger. The opening 82 is bordered on the lower face of the mounting plate 80 with a guide, which as illustrated is formed as three guide segments 83. As will be later described, the guide 83 is configured to receive an upper part of the mouthpiece 74 of the spout 32 when the spout 32 is in the retracted position (FIG. 10*a*). Further, when the flap 28 clears the opening 82 (FIG. 11*a*), the upper part of the mouthpiece 74 can be moved vertically upwardly through the opening 82 to the uppermost position (FIGS. 11 b and 11*c*). Movement of the spout 32 is in a direction generally along the first axis.

Figure 14B:
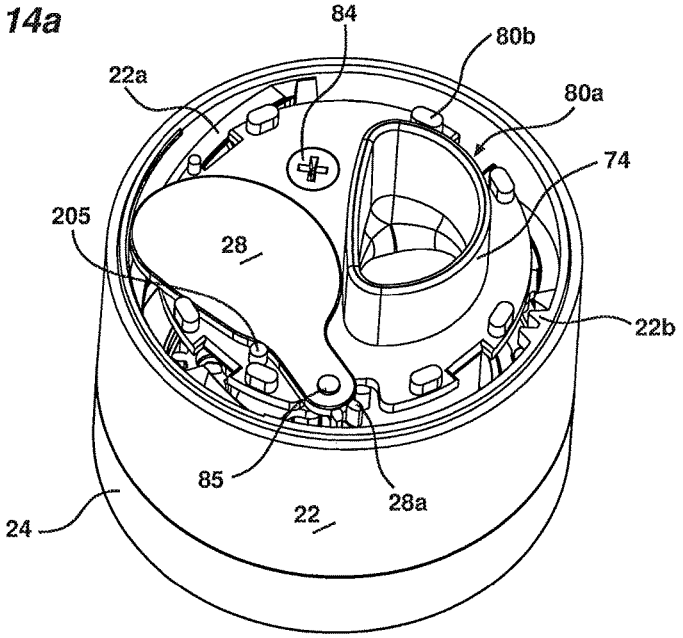

As shown in FIGS. 12*a* and 12*b*, the mounting plate 80 has two apertures 204 through which respective connectors 84 can be passed to connect the mounting plate 80 to the top of respective spring posts 40. Screw connectors 84 may be used to establish each of the connections. However, such screw connectors may be replaced with snap on or press fit connectors or any other suitable connection (e.g. a glued connection or welded). The mounting plate 80 also includes depending guides 83 that assist with the correct upward movement of the spout 32 as will be discussed later. A post 205 is positioned to act as a stop for the flap 28 as it is moved out of the way as illustrated in FIG. 14*b* and so that it is corrected positioned for engagement with the internal spur gear member 22*b* of the main body 22.

Mounting plate 80 also acts as a platform for mounting the flap 28 and the cover 20. As shown in FIGS. 14*a* and 14*b*, flap 28 includes a proximal end 206 and a distal end 208. The proximal end 206 is formed with a series of gear teeth 28*a*. The gear teeth or pinion 28*a* are arranged to intermesh with internal spur gear member 22*b* formed on the internal face of the main body 22 and thus a spur gear and pinion arrangement is established. Flap 28 is connected to mounting plate 80 so that the flap 28 can be driven across the plane of the upper face of the mounting plate 80 to move between a first closed position (FIG. 14*a*) in which the flap 28 overlies the opening 82 and a second open position (FIG. 14*b*) in which it is clear of the opening 82. More particularly, flap 28 is pivotally connected to the mounting plate 80 about a vertical axis extending through post 85. Accordingly, it will be understood that rotational movement of the main body 22 causes the flap 28, through the drive of intermeshed gear teeth 22*b*, 28*a*, to pivot about pivot post 85 between the first and second positions. Movement of the flap 28 is timed by the positioning of the spur gear member 22*b* and pinion 28*a* arrangement to ensure that the uppermost part of the spout 74 does not strike the underside of the flap 28 whilst the flap 28 is being moved into the second position.

Figure 13:
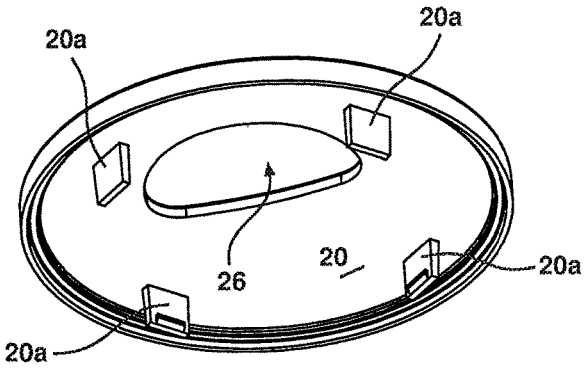
FIG. 13 is a bottom isometric view of the cover of the lid assembly of FIG. 1.

Cover 20 is arranged for connection to the mounting plate 80. Although simple threaded connectors (e.g. screws) could be used to connect the cover 20 to the mounting plate 80, a snap on type connection to the mounting plate 80 is preferred as it eliminates any fixtures or connectors on or through the uppermost face of the cover 20 and thus enhances the appearance of the cover 20. To this end, cover 20 includes four resilient connectors 20*a* (FIG. 13) extending from its underside. Each connector 20*a* is arranged to snap fit into a cut-out 80*a* formed in the mounting plate 80. It will be appreciated that the connection between the cover 20 and mounting plate 80 must be such so as to not impede movement of the flap 28 across the upper face of the mounting plate 80. Accordingly, mounting plate 80 is provided with posts 80*b*, positioned adjacent each cut-out 80*a* to ensure sufficient spacing between the upper face of the mounting plate 80 and the underside of the lid 20.

As mentioned previously, the opening 82 in the mounting plate 80 and the opening 26 in the lid 20 are vertically aligned. It will thus be appreciated that the flap 28 is effective to block a pathway through both of the aligned openings 82, 26. Further, as best illustrated in FIG. 10*b*, the mouthpiece 74 of the spout 32 is arranged to be located within the guide 83 (i.e. the three guide segments 83) formed below the opening 82 of the mounting plate 80 when the spout 32 is in the lowermost position. The guides 83 help to direct upward movement of the spout 32 through the aligned openings 82, 26 once the flap 28 is moved to the open position and inhibits it from catching on an edge of the openings 82.

FIGS. 15 to 17*b* illustrated the releasable latch 30 and locking member 34. The latch 30 of the present embodiment includes a detent 30*a*, a distal end 30*b*, a push button 30*c* and a slot 30*d*. The locking member 34 includes an elongate distal end 34*a*, a grip member 34*b* and a forwardly extending portion 34*c*.

The forwardly extending portion 34*c* of the locking member 34 can engage with the slot 30*d* of the latch 30 to inhibit the push button 30*c* from being pushed inward. The forwardly extending portion 34*c* can be disengaged from the slot 30*d* to permit activation of the latch 30.

Figure 15:
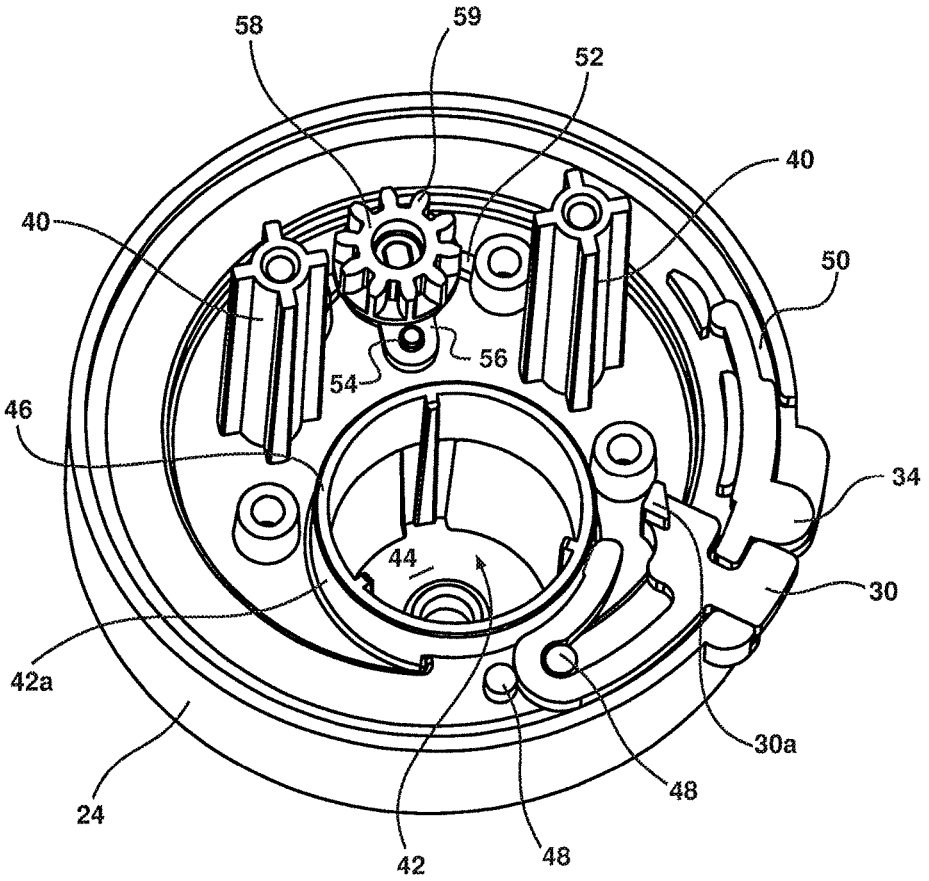
FIG. 15 is a view similar to FIG. 5 showing the latch and locking member mounted on the base.
Figure 16:
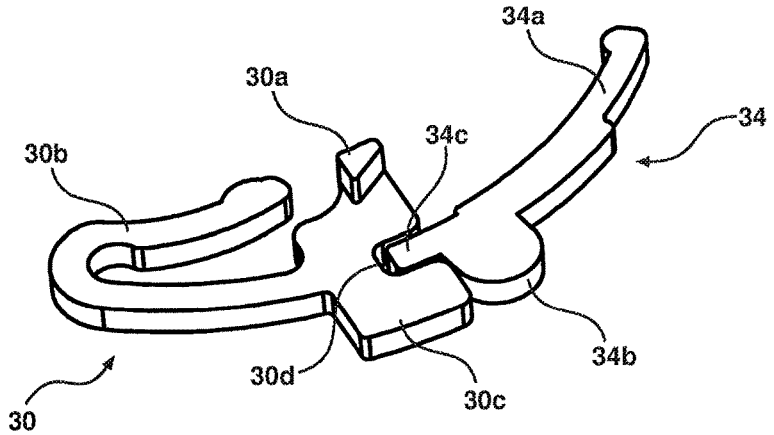
FIG. 16 is a top perspective view of the latch and locking member.
Figure 17A:
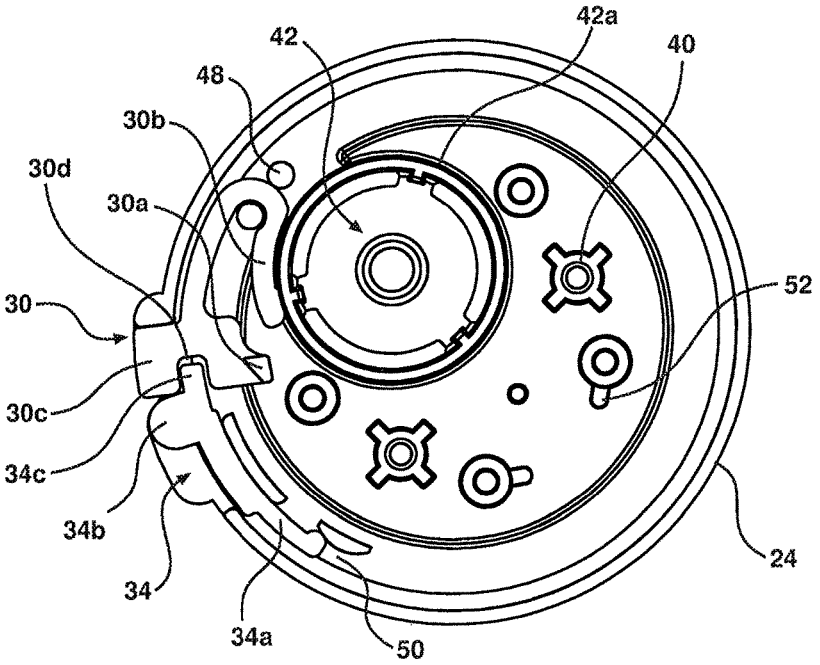
FIGS. 17*a* and 17*b* showing the latch and locking member of FIG. 15 with the slidable locking member in a first and a second position.
Figure 17B:
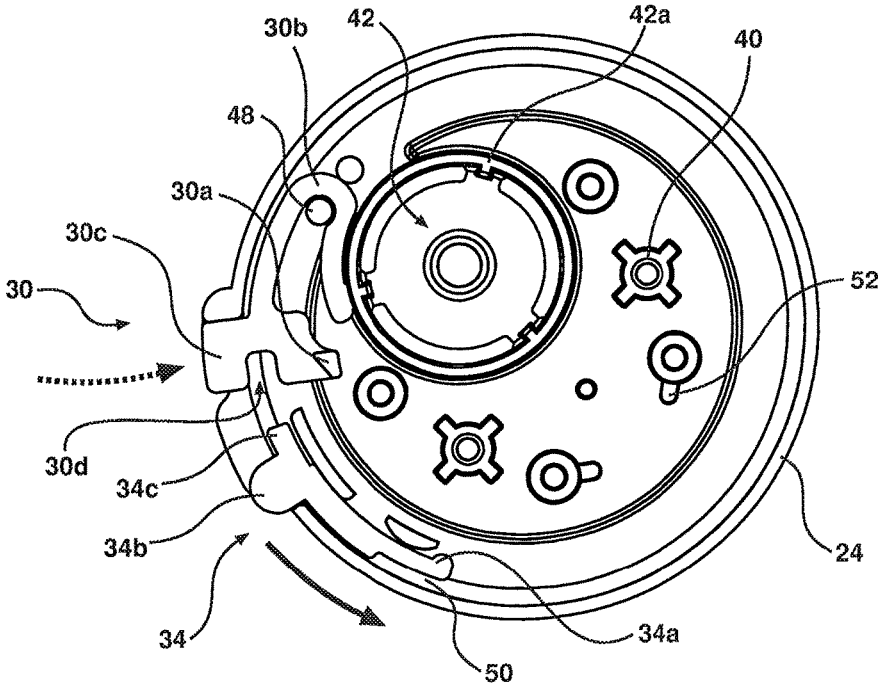

In order to drink fluid from the bottle 100, the user must press the push button 30*c* inwardly. Latch 30 is formed as a spring clip type configuration and is mounted on the push button post 48 as best shown in FIG. 15. Distal end 30*b* of the push button 30 is located against the wall 42*a* that defines the opening 42 in the base 24. When the push button 30*c* is pressed inwardly, the detent 30*a* also moves inwardly such that it is clear the locking slot 64*d* of the internal spur gear 64. The internal spur gear 64 is then free to rotate with the main body 22. Locking member 34 can be moved to a locked position in which it engages with a slot 30*d* of the latch 30 thereby preventing inward movement of the push button 30*c*. Accordingly, when the locking member 34 is in the locked position, latch 30 cannot be activated to release the internal spur gear 64 and therefore the spout 32 is held in the retracted position.

Once the push button 30*c* is pressed inwardly, the internal spur gear 64 with attached main body 22 are free to rotate. Rotation of the main body 22 and the internal spur gear 64 is driven by the bias of the springs 69. More particularly, the springs 69 cause the spout 32 to try to move vertically upwardly in the direction of the cover 20 and along the first axis. However, as the fingers 78 of the spout 32 are engaged with the underside of their respective thread starts 22*a*, upward movement of the spout 32 causes the main body 22 to rotate. As the main body 22 rotates, the spout 32 is able to move upwardly along the first axis. This upward movement continues until the fingers 78 bear against the underside of mounting plate 80. Each of the thread starts 22*a* includes a stop 22*e*, which assists in keeping the components together during assembly of the lid assembly 10.

In accordance with this embodiment, the main body 22 is driven to rotate in an anti-clockwise direction. This will inhibit a user from inadvertently screwing the lid assembly 10 off the bottle 100 during use, when they are moving the spout into the retracted position.

It will also be understood that as the main body 22 is engaged with the internal spur gear 64 and damper gear 58, rotation of the main body 22 is dampened, effectively controlling the speed of upward movement of the spout 32. Accordingly the spout moves in a controlled upward manner when the latch is released, which provides an appealing action for the user and inhibits the shearing off components that could otherwise occur with a rapid uncontrolled opening of the lid assembly 10.

As the main body 22 rotates, the gear teeth 22*b* on the main body 22 which are engaged with the gear teeth 28*a* of the flap 28, drive the flap 28 to rotate across the upper face of the mounting plate 80. The flap 28 is thus moved from the first closed position, overlying the opening 82 (FIG. 14*a*), to the second open position in which it is fully clear of the opening 82 (FIG. 14*b*).

There is a gap 210, as shown in FIG. 10*a*, between underside of the flap 28 and the uppermost part of the spout 32 when the spout is in the lowermost position. This allows the spout 32 to rise to a certain extent while the flap 28 clears the opening 26.

When the flap 28 is in the open position, the spout 32 is able to move upwardly through the aligned openings 82, 26 from the retracted position to the extended position. The speed of the upward movement of the spout 32 is controlled by the balance between the angle of the threads 22*a*, the dampening force of the dampener 56 and the bias of the springs 69. Rotation of the main body 22 through about 90 degrees enables the spout 32 to move from the lowermost position to the uppermost position. The pitch of the thread 22*a* on the main body 22 can be varied to alter the angle of rotation of the main body 22 required over which the spout 32 moves between the retracted and extended positions.

Twisting of the main body 22 by a user in a clockwise direction causes the spout 32 to lower (i.e. to be pushed or driven downwardly against the bias of the springs 69) due to the fingers 78 bearing against the underside of the threads 22*a*, which thereby caused the flap 28 to close. Detent 30*a* is driven over teeth start 64*b* of the internal spur gear 64 before locating within the locking gap 64*c* to prevent further movement of the internal spur gear 64 and thus the attached main body 22.

In accordance with a preferred embodiment, as the spout 32 moves upwardly to the extended position it further rotates the flap 28 across the face of the mounting plate 80. This additional movement or "bump" of the flap 28 beyond the second position may be required to ensure that when the main body 22 is rotated by the user in a clockwise direction to lower the spout 32, the gear teeth 28*a* of the flap 28 mesh cleanly with the gear teeth 22*b* formed on the main body 22. It will be appreciated, that proper operation of the bottle lid assembly 10 is achieved by appropriate positioning and configuration of the various components. This ensures, for example, that the flap 28 opens in a manner timely to allow the spout 32 to pass through the opening 28 without engaging the underside of the flap 28. Further, that the flap 28 returns to the first position to close the opening 28 when the user manually twists the main body 22.

As best understood by comparison of FIGS. 11 a and 11*c*, when the spout 32 is in the retracted position, the lower rim 32*a* of the spout 32 is located against an upper face of the seal button 60 and thus fluid from the bottle 100 cannot enter into the fluid pathway 70 of the spout 32. When the spout 32 is in the extended position, the lower rim 32*a* of the spout 32 is well clear of the seal button 60 and thus fluid from the bottle 100 can flow through the apertures formed in the seal button seat 44 and into the fluid pathway 70 of the spout 32.

Seal 62 seals the connection between the base 24, spout 32 and positioning disc 68. Seal 77 seals the connection between the lid assembly 10 and the bottle 100.

Embodiments of the present invention are advantageous because the spout is contained within the main body and below the lid when the spout is in the retracted position. Hence, the spout is protected from inadvertent damage and from contamination through contact with other objects. The flap prevents dirt and other contaminates reaching the spout when it is in the retracted position. Hence, a bottle fitted with a lid assembly in accordance with an embodiment of the invention can be safely stored in a hand bag or sports bag.

Operation of the lid assembly by the user is simple. The push of a button reveals the spout to the user. The flap moves from the first position to the second position and the spout moves generally vertically upwardly through an opening in the cover with a telescope like motion. When the user has finished drinking from the spout, the user simply rotates the main body which causes the spout to be retracted back into the main body. The flap then automatically returns to the first position to close access to the flap.

The dampened rotation of the main body provides a unique look and feel to the movement of the spout between the retracted and extended positions and also to the rotation of the main body.

The lid assembly has a clean design and unique appearance. The lid assembly can be connected to various different shapes and sizes of bottles.

The lid assembly can be locked to prevent against inadvertent movement of the spout to the extended position. This ensures that the lid assembly is not accidentally opened to allow fluid to flow through the spout. Hence, the lid assembly will not allow accidental fluid escape when stored in a bag or when the bottle is accidentally knocked over.

Various features of the invention have been particularly shown and described in connection with the exemplified embodiments of the invention, however it must be understood that these particular arrangements merely illustrate the invention and it is not limited thereto. Accordingly the invention can include various modifications, which fall within the spirit and scope of the invention.

The invention claimed is:

1. A lid assembly for a bottle, comprising:

a base attachable to said bottle over a mouth thereof;

a main body rotatably connected to said base;

a cover configured to extend over an open upper end of the main body, the cover including an opening extending therethrough;

a spout slidably held within said main body and movable along a first axis between a retracted position in which the spout is located within the main body and an extended position in which the spout projects through said opening in the cover;

a pivotable flap configured to close the opening in said cover when the spout is in said retracted position, wherein pivoting of the flap is actuated by movement of said main body;

wherein the flap is pivotably mounted to or adjacent said cover and movable in a plane that is generally perpendicular said first axis;

wherein the main body is generally cylindrical and includes an internal spur gear member that is configured to cooperate with a pinion on said flap wherein upon rotation of said main body the internal spur gear member is engageable with said pinion to move said flap across or clear of, said opening in the cover; and wherein the internal spur gear member engages the pinion for only a period of time during rotation of the main body, wherein when the internal spur gear member and pinion are not engaged the flap remains substantially stationary while the main body continues to rotate.

2. The lid assembly accordingly to claim 1 wherein the flap is pivotable between a first position, wherein the opening in the cover is closed and a second position wherein the opening in the cover is open thereby permitting the spout to extend through said opening.

3. The lid assembly according to claim 1 wherein the spout is biased from the retracted position towards the extended position by a biasing member.

4. The lid assembly according to claim 3 wherein the biasing member is a helical spring, a gas strut, a compression spring, a torsion spring, a constant tension spring or an elastomer block.

5. The lid assembly according to claim 3 wherein the spout is held against an influence of the biasing member in the retracted position by a releasable latch.

6. The lid assembly according to claim 5 further including a locking member configured to prevent inadvertent activation of the releasable latch.

7. The lid assembly according to 5 wherein upon release of the releasable latch the biasing member acts on the spout to move the spout into the extended position wherein the spout causes rotation of the main body in a first direction.

8. The lid assembly according to claim 7 wherein rotation of the main body in a second direction drives the spout along the first axis against the bias of the biasing member into the retracted position.

9. The lid assembly according to claim 1 wherein the spout and main body are coupled together by at least one thread member.

10. The lid assembly according to claim 9 wherein the thread member is a three start thread and the spout includes three engagement fingers, each of the three engagement fingers positioned for engagement with one of the starts of the three start thread.

11. The lid assembly according to claim 1 wherein a dampening member dampens rotation of the main body.

12. A bottle for holding a fluid, including the lid assembly according to claim 1.

13. A lid assembly for a bottle, comprising:

a base attachable to said bottle over a mouth thereof;

a main body rotatably connected to said base;

a cover configured to extend over an open upper end of the main body, the cover including an opening extending therethrough;

a spout slidably held within said main body and movable along a first axis between a retracted position in which the spout is located within the main body and an extended position in which the spout projects through said opening in the cover;

a biasing member to cause the spout to move along the first axis from the retracted position to the extended position and does not cause the spout to move along the first axis from the extended position to the retracted position;

threads on an inner surface of the main body to cause the spout to move along the first axis from the extended position to the retracted position during rotation of the main body; and a pivotable flap configured to close the opening in said cover when the spout is in said retracted position, wherein pivoting of the flap is actuated by movement of said main body.

* * * * *